US007993664B2

(12) United States Patent
Falkowski et al.

(10) Patent No.: US 7,993,664 B2
(45) Date of Patent: Aug. 9, 2011

(54) METHOD FOR FINISHING TEXTILES WITH SKIN-CARE OILS

(75) Inventors: Jürgen Falkowski, Monheim (DE); Werner Mauer, Albersloh (DE); Robert Schütz, Tönisvorst (DE); Raymond Mathis, Düsseldorf (DE)

(73) Assignee: Cognis IP Management GmbH, Duesseldorf (DE)

( * ) Notice: Subject to any disclaimer, the term of this patent is extended or adjusted under 35 U.S.C. 154(b) by 485 days.

(21) Appl. No.: 12/097,284

(22) PCT Filed: Dec. 5, 2006

(86) PCT No.: PCT/EP2006/011648

§ 371 (c)(1),
(2), (4) Date: Jun. 13, 2008

(87) PCT Pub. No.: WO2007/068372

PCT Pub. Date: Jun. 21, 2007

(65) Prior Publication Data

US 2008/0268005 A1 Oct. 30, 2008

(30) Foreign Application Priority Data

Dec. 14, 2005 (DE) ..... 10 2005 059 721

(51) Int. Cl.
*A61K 8/02* (2006.01)
*A61Q 19/00* (2006.01)

(52) U.S. Cl. ..... 424/402; 424/401

(58) Field of Classification Search ..... None
See application file for complete search history.

(56) References Cited

U.S. PATENT DOCUMENTS

| | | | | |
|---|---|---|---|---|
| 5,025,653 | A | 6/1991 | Schuldt | |
| 6,149,926 | A * | 11/2000 | Venkitaraman et al. | 424/402 |
| 2003/0215417 | A1 | 11/2003 | Uchiyama et al. | |
| 2003/0216488 | A1 * | 11/2003 | Uchiyama et al. | 523/102 |

FOREIGN PATENT DOCUMENTS

| | | | |
|---|---|---|---|
| EP | 0 345 568 | A2 | 12/1989 |
| WO | WO 99/32706 | * | 7/1999 |
| WO | WO 99/32706 | A1 | 7/1999 |

OTHER PUBLICATIONS

K. Lacasse and W. Baumann, Textile Chemicals, Environmental Data and Facts, Berlin, (2004), pp. 468-482.

* cited by examiner

*Primary Examiner* — Robert A Wax
*Assistant Examiner* — Danah Al-Awadi
(74) *Attorney, Agent, or Firm* — Diehl Servilla LLC

(57) ABSTRACT

A process for finishing textiles with skin-care oils including spraying, onto a textile, an aqueous emulsion with a Brookfield viscosity below 200 mPas at 20° C., including (a) water; (b) one or more skin-care oils; and (c) one or more emulsifiers is provided.

6 Claims, No Drawings

METHOD FOR FINISHING TEXTILES WITH SKIN-CARE OILS

CROSS-REFERENCE TO RELATED APPLICATIONS

This application is the national phase under 35 U.S.C. §371 of PCT International Application No. PCT/EP2006/011648 which has an International filing date of Dec. 5, 2006, which designated the United States of America and which claims priority on German Patent Application number DE 102005059721.1, filed Dec. 14, 2005, the entire contents of each of which are hereby incorporated herein by reference.

BACKGROUND OF THE INVENTION

1. Field of the Invention

This invention relates generally to a process for finishing textiles with skin-care oils, and more particularly, to a process for finishing textiles with an aqueous emulsion containing one or more skin-care oils.

2. Background Information

High-quality textiles are being increasingly finished with oil mixtures which impart skin-care properties to the textiles. These oil mixtures are capable of imparting moisturizing, smoothing or lipid-layer-enhancing properties to the skin when taken up through the textile fabric. For the factory finishing of textiles with oil mixtures, the oil mixtures are normally used in the form of an aqueous emulsion which is further diluted in the textile liquor. These aqueous solutions may then be used, for example in a padding or absorption process for finishing textiles. After a few wash cycles, however, the effect of the factory finish deteriorates.

Accordingly, there is a need for simple processes which would restore the particular properties of the factory finish to the textile.

SUMMARY OF THE INVENTION

Briefly described, according to an aspect of the invention, a process for finishing textiles with skin-care oils includes spraying, onto a textile, an aqueous emulsion with a Brookfield viscosity below 200 mPas at 20° C., comprising: (a) water; (b) one or more skin-care oils; and (c) one or more emulsifiers.

According to another aspect of the invention, a process for finishing textiles with skin-care oils includes spraying, onto a textile, an aqueous emulsion with a Brookfield viscosity below 200 mPas at 20° C., consisting of: (a) water; (b) one or more skin-care oils; and (c) one or more emulsifiers.

DETAILED DESCRIPTION OF THE INVENTION

The problem addressed by the present invention was to provide a process which would be easy to apply and which would restore the particular properties of the factory finish to the textile in regard to skin-care oils. The stated problem is excellently solved in every respect by the process according to the present invention.

The present invention relates to a process for finishing textiles with skin-care oils in which aqueous emulsions with a Brookfield viscosity below 200 mPas (as measured at 20° C.) containing (a) water, (b) one or more skin-care oils and (c) one or more emulsifiers are applied to textiles, characterized in that the aqueous emulsion is applied to the textile by spraying.

If desired, the aqueous emulsion may contain other components besides components (a), (b) and (c), for example viscosity adjusters, anionic wetting agents or microcapsules. The microcapsules may in turn be charged with various components, including skin-care oils. In addition, the aqueous emulsion may contain special moisturizing, invigorating additives such as, for example, urea, glycerol, caffeine, menthol or fruit acids, which are dissolved in the aqueous phase of the oil-in-water (o/A) emulsion.

In a preferred embodiment, the Brookfield viscosity of the aqueous emulsion applied by spraying is below 100 mPas (as measured at 20° C.), more particularly below 50 mPas, and preferably below 20 mPas.

The emulsion to be sprayed in accordance with the invention may be a conventionally produced o/w emulsion ("macroemulsion") or even a so-called PIT emulsion or micro- or nanoemulsion known to the expert.

In one particular embodiment, the oil content of the aqueous emulsion is between 1 and 50% by weight, based on the emulsion as a whole, and preferably between 5 and 20% by weight.

The aqueous emulsion is sprayed directly onto the textile. After a brief drying period, the textile shows its original skin-care properties.

Hitherto, sprays for treating textiles have only been known in the care of textiles as such. Examples include sprays as ironing aids, for eliminating trace odors and for applying perfumes.

By contrasts the process according to the invention is concerned with the application of skin-care oils to textiles by spraying, the function of these oil components being to care for the human skin. The process according to the invention is particularly suitable for finishing textiles which are worn next to the skin with care oils. The textile can be used, i.e., worn, after a short drying time. In the process according to the invention, the skin-care effect can be distributed through the quantity sprayed on. Besides the skin-care properties, the spray can also provide the textile with a better feel or greater smoothness which, for example, makes close-fitting articles of clothing (for example compression stockings) easier to put on.

In one embodiment, the present invention is characterized by a process for finishing textiles with skin-care oils in which aqueous emulsions with a Brookfield viscosity below 200 mPas (as measured at 20° C.) consisting of (a) water, (b) one or more care oils and (c) one or more emulsifiers are applied to textiles, characterized in that the aqueous emulsion is applied to the textile by spraying.

Compounds b)

As already mentioned, component (b) consists of skin-care oils. The term "oil" is not used in the chemically narrow sense of "triglyceride". Rather, an oil is understood to be a component which has an oily consistency at room temperature. Component (b) is preferably selected from the group consisting of monoglycerides, diglycerides, triglycerides and fatty acid alkyl esters. These substances may be both substances of natural origin and synthetic substances.

In one embodiment, the oils (b) are not only skin-care substances themselves, they may also contain other oil-soluble skin-care substances in dissolved form.

Suitable oils (b) may be selected, for example, from the following classes of substances: triglycerides, fatty acid alkyl esters, fatty alkyl ethers, fatty alkyl carbonates, branched and unbranched hydrocarbons. Examples of suitable substances include coconut oil, squalane, vitamin E, Myritol 318, Cetiol SN, paraffins and white oils.

Compounds c)

As already mentioned, the compounds (c) are emulsifiers. The function of these emulsifiers is to emulsify the skin-care oils (b) in water. Basically, there are no particular limits as to the choice of the emulsifiers.

The emulsifiers (c) may be conventional synthetic emulsifiers, such as ethoxylated fatty alcohols for example, or natural emulsifiers, such as lecithin for example. Emulsifiers with an Hydrophilic-Lipophilic Balance (HLB) value of 8 to 18 are preferred.

If Phase Inversion Temperature (PIT) emulsions are used, special emulsifier mixtures, such as Emulgade SE-PF (manufacturer: Cognis) for example, are preferred.

In one embodiment, the compounds c) are polymeric emulsifiers, i.e., compounds which, structurally, may be regarded as polymers and which have an emulsifying effect on the skin-care oils b). Examples of polymeric emulsifiers c) of which the monomer units are of natural origin are polymers based on cellulose (for example, sodium carboxymethyl cellulose) or polysaccharides (for example, xanthan gum, gellan gum, guar or pectins). Examples of polymeric emulsifiers c) of which the monomer units are of synthetic origin are acrylates (for example, sodium polyacrylates), methacrylates or alkyl acrylates (for example, pemulen). If desired, the monomer units of which the emulsifiers c) are made up may also be chemically modified. In a most particularly preferred embodiment, compounds selected from the group consisting of xanthan gum, gellan gum, guar, polyacrylates are used as the polymeric emulsifiers c). These emulsifiers may be used individually or in admixture with one another.

Microcapsules n)

In the context of the present invention, microcapsules are basically understood to be organic polymers with a certain three-dimensional structure (cf.: K. Lacasse and W. Baumann, Textile Chemicals, Environmental Data and Facts, Berlin 2004, pages 468-482). So far as their three-dimensional structure is concerned, the microcapsules are hollow microspheres which typically have a diameter of 2 to 2,000 μm and an external diameter of 0.1 to 200 μm and, more particularly, 0.5 to 150 μm. Because they are hollow, the microcapsules can be charged with ingredients or active components.

Charged microcapsules, i.e., microcapsules charged with one or more ingredients or active components, are always used for the purposes of the present invention. In principle, the ingredients or active components may be any substances which are intended to be passed onto the skin during the wearing of the textile finished with the charged microcapsules. Such substances include, for example, fats, oils, plant extracts, vitamins, perfumes, repellents, insecticides and the like. Preferred oils are vegetable oils with skin-care and health-promoting properties, for example coconut oil, passion flower oil, shea butter, rose hip seed oil, lavender oil, apricot kernel oil. Preferred plant extracts are rhodysterol and aloe vera. Of particular importance for the purposes of the invention are active components or ingredients which have skin-care, moisturizing, stimulating, soothing, cellulitis-reducing, skin-firming, repellent and refreshing properties.

The encapsulated substances—hereinafter also referred to as the core material—may consist of any solid, liquid or gaseous materials which are to be incorporated in corresponding products in encapsulated form. Perfumes, such as perfume oils, or substances with a care effect in the intended field of application are preferably used as the core materials.

Individual perfume compounds may be used as perfume oils or perfumes and include, for example, synthetic products of the ester, ether, aldehyde, ketone, alcohol and hydrocarbon type. Examples of perfume compounds of the ester type are benzyl acetate, phenoxyethyl isobutyrate, p-tert.butyl cyclohexylacetate, linalyl acetate, dimethyl benzyl carbinyl acetate, phenyl ethyl acetate, linalyl benzoate, benzyl formate, ethylmethyl phenyl glycinate, allyl cyclohexyl propionate, styrallyl propionate and benzyl salicylate. Ethers include, for example, benzyl ethyl ether while aldehydes include, for example, the linear alkanals containing 8 to 18 carbon atoms, citral (geranial), citronellal, citronellyloxyacetaldehyde, cyclamen aldehyde, hydroxycitronellal, lilial and bourgeonal. Examples of suitable ketones are the ionones, α-isomethylionone and methyl cedryl ketone. Suitable alcohols are anethol, citronellol, eugenol, isoeugenol, geraniol, linalool, phenylethyl alcohol and terpineol. The hydrocarbons mainly include the terpenes, such as limonene and α-pinene. Eucalyptol (1,8-cineol) may also be used as a perfume. However, it is preferred to use mixtures of different perfume compounds which, together, produce an agreeable fragrance. Such perfume oils may also contain natural perfume mixtures which are obtainable from vegetable sources, for example pine, citrus, jasmine, patchouli, rose or ylang-ylang oil. Other suitable perfume oils are sage oil, camomile oil, clove oil, melissa oil, mint oil, eucalyptus oil, cinnamon leaf oil, lime-blossom oil, juniper berry oil, vetiver oil, olibanum oil, galbanum oil and ladanum oil and orange blossom oil, neroli oil, orange peel oil and sandalwood oil. Other suitable perfumes are nitrites, sulfides, oximes, acetals, ketals, acids, Schiffs bases, heterocyclic nitrogen compounds, such as indole and quinoline, pyrazines, amines, such as anthanilates, amides, organohalogen compounds, such as rose acetate, nitrated compounds, such as nitromusk, heterocyclic sulfur compounds, such as thiazoles, and heterocyclic oxygen compounds, such as epoxides, which are all known to the expert as possible perfumes.

Examples of care components are vitamins and provitamins, such as vitamin A, vitamin C, vitamin E (α-tocopherol), vitamin F (polyene fatty acids), panthenol (provitamin B5), β-carotene (provitamin A) and derivatives thereof (for example esters, such as stearyl ascorbate), plant extracts, biopolymers, antidandruff agents, UV protection factors, emollients (cosmetic oils), and silicone oils.

For cosmetic applications, preferred care components are tocopherols and lipid-soluble derivatives thereof. Suitable tooopherols are, for example, the natural tocopherols and mixtures thereof and synthetic tocopherols. Suitable derivatives are, for example, tocopheryl acetate, tocopherol nicotinate, tocopheryl ascorbate, tocopheryl retinoate, tocopheryl succinate, tocopheryl linoleate or tocopheryl benzoate.

What is claimed is:

1. A process for restoring the finish of a textile with oils, comprising the steps of:

(1) providing a textile in need of restoration of the skin-care finish, and (2) spraying said textile with an aqueous emulsion comprising:

(a) water;

(b) one or more skin-care oils; and (c) one or more emulsifiers, wherein said emulsion has a Brookfield viscosity below 200 mPas at 20° C.

2. The process according to claim 1, wherein said emulsion further comprises microcapsules.

3. A process for restoring the finish of a textile with skin-care oils, comprising the steps of:

(1) providing a textile in need of restoration of the finish, and (2) spraying said textile with an aqueous emulsion consisting of:

(a) water;

(b) one or more skin-care oils;

(c) one or more emulsifiers, and (d) optionally, microcapsules, wherein said emulsion has a Brookfield viscosity below 200 mPas at 20° C.

4. The method of claim 1, wherein the skin-care effect of the textile is restored.

5. The method of claim 2, wherein the skin-care effect of the textile is restored.

6. The method of claim 5, wherein the skin-care effect of the textile is restored.

* * * * *